United States Patent [19]

Schaad

[11] 4,234,059

[45] Nov. 18, 1980

[54] BRAKING SYSTEM FOR FREIGHT MODULE ON OVERHEAD GUIDE RAIL

[75] Inventor: Willi Schaad, Unterentfelden, Switzerland

[73] Assignee: Oehler Whylen Lagertechnik AG, Buchs near Aarau, Switzerland

[21] Appl. No.: 961,830

[22] Filed: Nov. 17, 1978

[30] Foreign Application Priority Data

Nov. 17, 1977 [DE] Fed. Rep. of Germany ..... 2751367

[51] Int. Cl.[3] ..... B61H 7/12

[52] U.S. Cl. ..... 188/43; 105/150

[58] Field of Search ..... 188/38, 41, 42, 43, 188/44, 72.7; 105/148, 150, 151

[56] References Cited

U.S. PATENT DOCUMENTS

| | | | |
|---|---|---|---|
| 780,214 | 1/1905 | Monnier | 188/43 |
| 2,380,055 | 7/1945 | Linden et al. | 188/72.7 |
| 3,017,958 | 1/1962 | Richter | 188/43 |
| 3,987,734 | 10/1976 | Horn | 105/148 |

FOREIGN PATENT DOCUMENTS

| | | | |
|---|---|---|---|
| 520318 | 6/1928 | Fed. Rep. of Germany | 188/43 |
| 2105402 | 4/1972 | France | 188/42 |
| 13679 | 1/1897 | Switzerland | 188/43 |
| 1174588 | 12/1969 | United Kingdom | 188/44 |

*Primary Examiner*—Edward R. Kazenske
*Attorney, Agent, or Firm*—Abraham A. Saffitz

[57] ABSTRACT

A braking system for a freight module, crane module, or the like which is suspended for movement on an overhead guiding rail having the form of an I beam with upper and lower horizontal flanges and a vertical web in which braking results from the pincer action of pivoted pincers having upper arm portions pressing brake shoes, one mounted on each pincer, against the vertical web of the I beam. The lower arm portions of each pincer diverge outwardly and downwardly to provide a triangular opening below the pivot pin and a rectangular opening at the bottom ends. A tension spring is mounted at the base of the triangular portion. A parallelogram shaped cam disc having curved ends is mounted for opening movement between base plates at the sides of the rectangular opening. A motor and shaft rotate the cam through a predetermined arc to apply the braking movement in a controlled manner to gradually slow down the module and avoid oscillations of the module.

3 Claims, 7 Drawing Figures

BRAKING SYSTEM FOR FREIGHT MODULE ON OVERHEAD GUIDE RAIL

The present invention relates to a system for braking the movement of a part of a storage machine, crane bridge, or the like which is movably, guided on an overhead guide rail which executes a preprogrammed movement. Furthermore, the invention relates to a dynamic rail brake apparatus and method to carry out the preprogrammed movement.

DESCRIPTION OF THE PRIOR ART

In the case of known storage machines which have a greater height as compared to their base dimensions and surface area and are supported by guide rails, often disturbing vibrations of the mast construction of the storage machine along its height or vertical dimension occur which prevent a precise positioning and an exact control of the movements for storing and removing of loads from the movable storage machine. Frequently fading movement occurs during stopping for which one must wait until the desired next step can be taken. Similar problems often occur in the case of large cranes which are suspended for overhead movement on a guiding rail, where in the case of braking the movement of the crane, the entire crane construction may start to vibrate. This constitutes an extraordinary load for the construction so that the endangered parts undergoing dynamic stresses must be reinforced. Additionally, the travel movements must be slowed down considerably to reduce these stresses so that a disproportionately much time is needed for the disengagement of the braking system from its bearings.

In order to remedy these disadvantages of these known systems, the proposal has already been made to a braking mechanism located upon the movable storage machine on the mast head (front portion thereof) guided along an overhead guide rail by means of pinching brakes, on said guide rail. The known braking arrangements however act in sudden bursts, because the braking force starts full force, as a result of which the construction is strained additionally, whereby premature breaks may occur. Such pinching brakes which operate in sudden bursts and with a immediate effect of the full braking force is described for example, in the Swiss Pat. No. 13679.

OBJECTS OF THE INVENTION

It is an object of the present invention to provide a new braking apparatus and method which results in a solution of the braking problems described in the prior art and which no longer suffers from the above mentioned disadvantages.

Another object of the invention is to provide a system and a rail brake by means of which the vibrations of the mast shaped freight module occurring upon sudden braking movement or upon movement delay are substantially completely neutralized or at least considerably reduced. At the same time the braking action in the system of the invention increases progressively and quickly with a preadjustable braking force and braking time from close to zero up to a chosen maximum value.

Other and further objects of the invention will be seen from the summary of the invention, drawings, the more detailed description of the preferred embodiments and the claims.

SUMMARY OF THE INVENTION

A braking system for a freight module, a crane module or the like which is suspended for movement on an overhead guiding rail having the form of an I beam with two horizontal flange portions and a vertical connecting web therebetween in which the braking means comprises a pair of pivoted braking pincers, each of the pincers pair having an upper arm portion for pushing a brake shoe against a side of the vertical web of the I beam and a lower arm portion which diverges outwardly and downwardly in a first triangle shaped area for engaging a tension spring and in a second rectangular area therebelow for base plates, one on each lower end of the arm and a parallelogram shaped cam disc having arcuate ends which engage said base plates and urge the cam disc to be rotated by a motor, preferably a servo motor, against the plates to control the pinching action of the upper pincer ends of the braking pincers.

The brake linings of the brake shoes consist of an abrasion resistant plastic material which is well known in the art as brake lining plastic and which, when released from the pincer pressure, has low friction surface characteristics to impart a gliding movement against the vertical web portion of the I beam while, under increasing pressure, exhibits a higher frictional resistance to provide an increased braking effect.

Thus upon controlled movement of the parallelogram shaped cam disc through a predetermined angle of about 40°, the curved ends of the cam disc, which turn through this angle, impart a sinusoidal displacement of about 55 mm to 75 mm at the arcuate ends to thereby force the base plates apart by this limited, arcuately defined distance through a movement which starts slowly and then quickens after the displacement is well underway. In this manner the cam disc movement is transferred to the bottom ends of the pincer arms through the base plate to push the pincers apart at the bottom and together at the top arm portions against the tension spring which is placed in horizontal relationship immediately below the pivot pin of the brake pincers.

Because of the criticality of both time and cam disc displacement in reducing objectionable vibrations, it is necessary that the braking system be in a positive condition of release or in a condition of braking adjustment through the cam rotating angle of up to 40° by motor means which responds quickly yet is properly adjustable and that the braking system include disengaging bearing means to assure the positive condition of release. For this latter purpose, grooved ball bearing means engage and cooperate with the arcuate sides of the cam disc to assure quick, unimpeded release with the disc rotated into the release position. To provide infinite adjustment of the angular rotation of the cam, a servo motor and output shaft produce the required rotational movement within one second or a fraction of one second for the start and permit lengthening the time to about three seconds for a slowly controlled braking movement.

It has been discovered that a preprogrammed process for braking the storage machine, crane bridge, or the like can be carried out by triggering braking at predetermined locations along the path passed through by the freight module and that this triggered, mechanical braking action rises unevenly from zero to a maximum value. Effectively, the braking action will have an approximately sinusoidally rising course in the method of minimizing vibration.

According to the method of the invention, the rail brake is characterized in that the ends of the clamping arms facing away from the brake shoes fit against the servo motor rotatable cam disc, disposed between said arms, whereby as a result of the twisting of the cam disc from the rest position into the active position by said motor, the spreading apart of the clamping arms and the engagement of the brake shoes with the overhead guide rails takes place with an unevenly increasing braking effect. At the same time, the pretensioned spring forces in the tension springs below the pin of the pincers exerts a damping counter effect on the spreading apart forces and the maximum braking effect is thus regulated by the preadjustment of the spring tension.

BRIEF DESCRIPTION OF THE DRAWINGS

In the attached drawing a preferred embodiment of the rail brake according to the invention is shown as follows:

FIG. 6 illustrates a vibration oscillogram of the storage module without switching on the rail brake of the invention, and FIG. 7 illustrates an oscillogram of the mast head with the rail brake switched on.

DESCRIPTION OF THE PREFERRED EMBODIMENT

Figure 1:
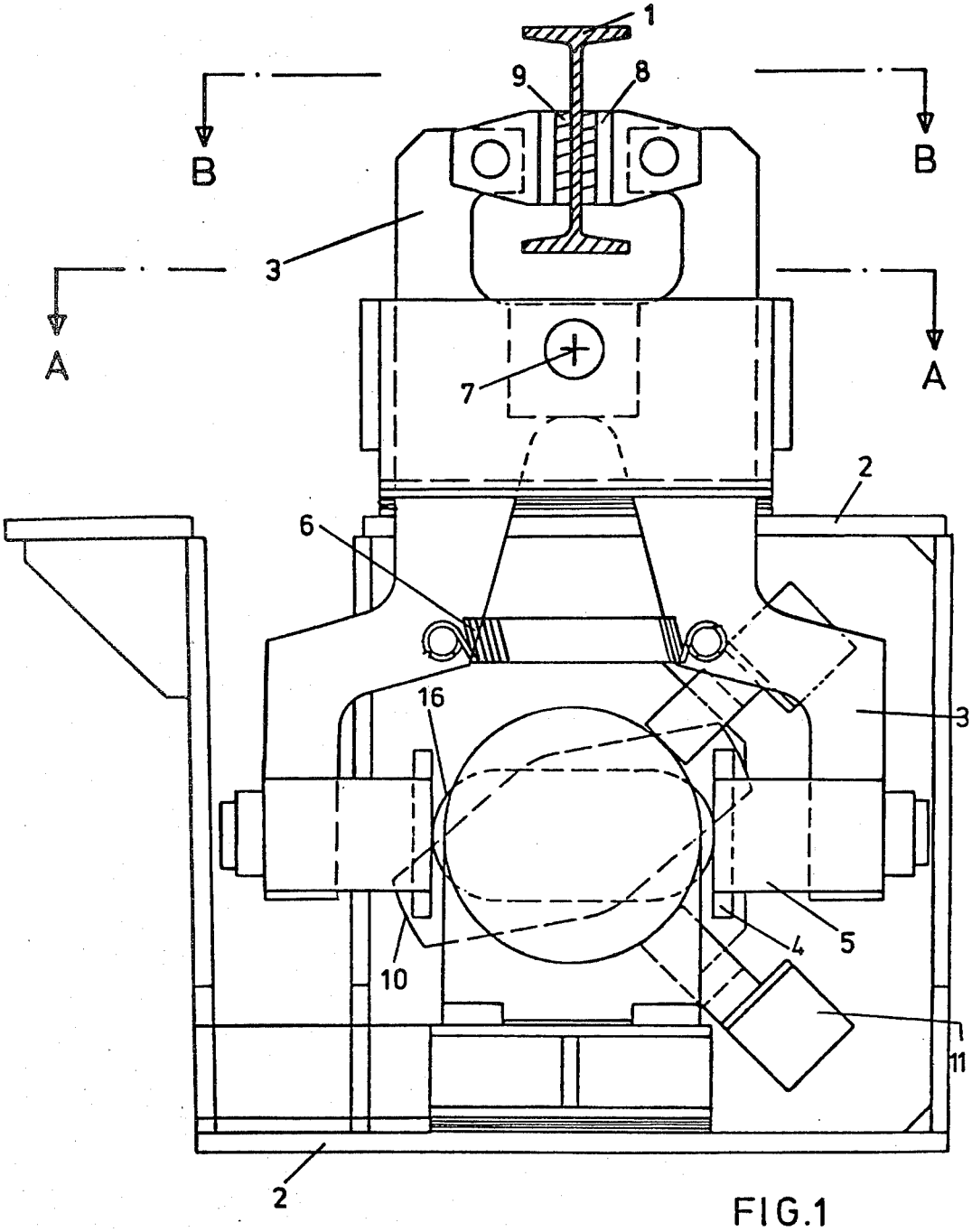
FIG. 1 which shows a front elevational view of the rail brake.

The process described for preprogrammed movement in the present invention will be explained subsequently in connection with a guide rail which is movable on rails but for the purposes of developing the preprogrammed movement testing was done with the braking system laid on the floor, whereby the movements of the brake shoes against the rail are effectively preprogrammed and are controlled by a servo motor operating as an automatic control. The preferred module is a storage machine which is used in connection with automatic high level shelf storage spaces for the storing and removal of any kind of goods, and the detailed pertinent construction is well known and is not the object of the present invention. In FIG. 1, the front top or mast head of the storage machine 2 is shown which is equipped with a pincers brake 3 which is guided along a rail 1 and cooperates with it. This rail 1 serves as a guide for the top wheels (not shown) of the lifting mast of the storage machine and it serves at the same time as a guide rail for a cable trolley.

The brake pincers consist of two clamping arms 3 which are pivoted on pin 7 to be disposed swivelably around the horizontal axis of the pin 7. Between the lower parts of the clamping arms 3, a tension spring 6 is located in the triangular base part of the divergent arms 3 and is clamped to thereby pull together the lower parts of the clamping arms as a result of which opening movement of the pincers takes place. The upper parts of the clamping arms 3 are provided with brake shoes 8 to frictionally engage opposite sides of the guide rail along a common area of the rail 1. The brake shoes 8 are connected to the inner pincer ends of 3 and are equipped with brake linings 9. The brake linings 9 consist of an abrasion resistant plastic which, in the released state, has sliding characteristics but which shows an increasing friction effect with increasing pressure. As a result of these characteristics one will achieve some slippage in the case of an initially only slight contact pressure between the brake linings 9 and the rail 1. However a scoring of the brake and a blocking of the brake will not occur. The closing path for the brake shoes amounts to about 8–10 mm.

Figure 2:
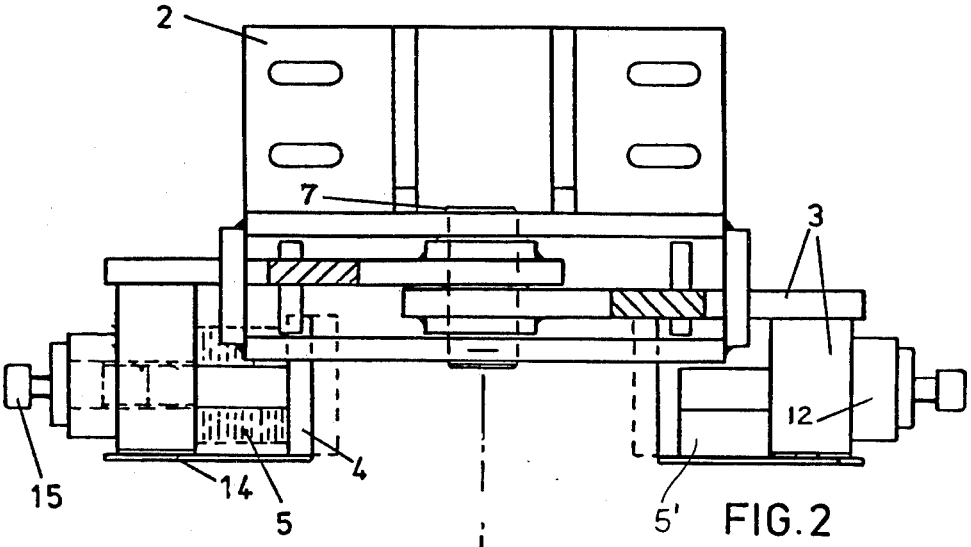
FIG. 2 which shows a sectional view following line A—A in FIG. 1.
Figure 3:
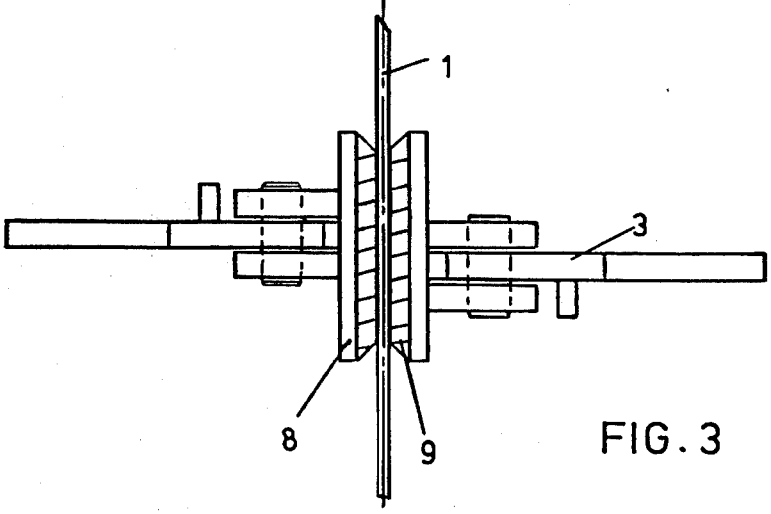
FIG. 3 which shows another sectional view along line B—B in FIG. 1.

The lower parts of the clamping arms are each provided with a base plate 4. The two base plates 4 are mounted slidingly at the lower ends of the arms along the base of the rectangular opening provided by the divergent downward shape of these ends and these plates 4 are retained under the effect of the two respective plate springs 5 which are housed each one in a spacer sleeve 5' as shown on FIG. 2. The pretension of the spring 5 may be adjusted to a predetermined valve with the help of a set screw 15 between the base plate 4 and a pressure plate 12. The base plates 4 are secured against twisting by guide blocks 14. The adjusting path of each base plate 4 amounts to about 20–35 mm.

Figure 5:
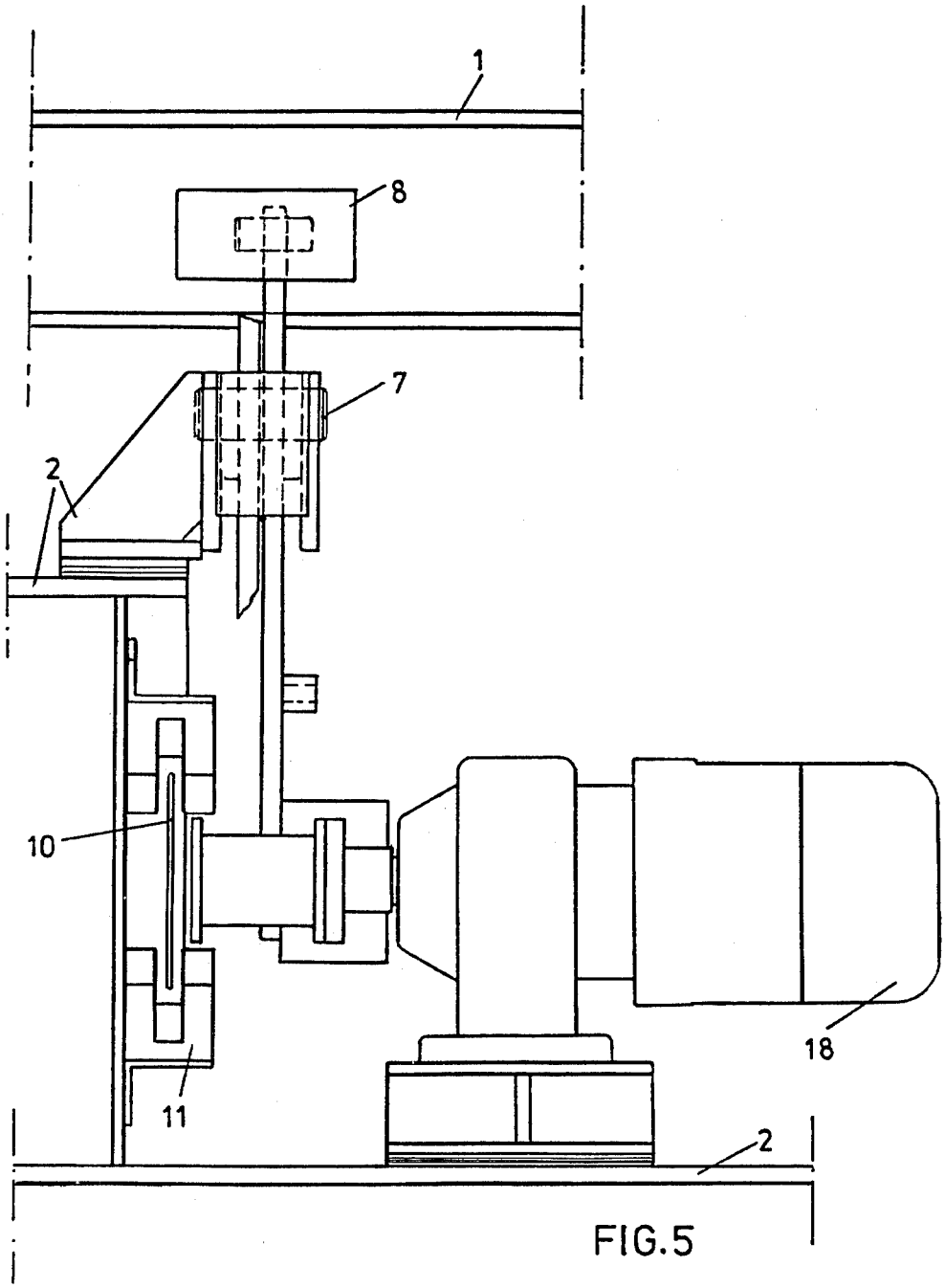
FIG. 5 illustrates a side elevational view of FIG. 1 with the clamping arms omitted.

A cam disc 16 is disposed rotatably between the two base plates 4 and the cam disc 16 is keyed onto the shaft of a servo motor 18 provided for closing the brake shoes 8 (see FIGS. 1 and 5). Furthermore, the servo motor shaft carries a measuring flag 10 which, in the case of the rotational movement of the cam disc 16, is moved between two measuring elements 11 disposed to 90°, so that the position of the cam disc may be monitored and recorded.

Figure 4B:
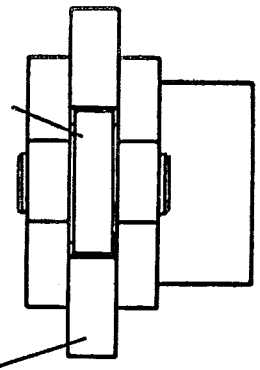
FIG. 4A, 4B and 4C which shows in outline a more detailed development of a preferred cam disc viewed from the front, from above and from the side.
Figure 4C:
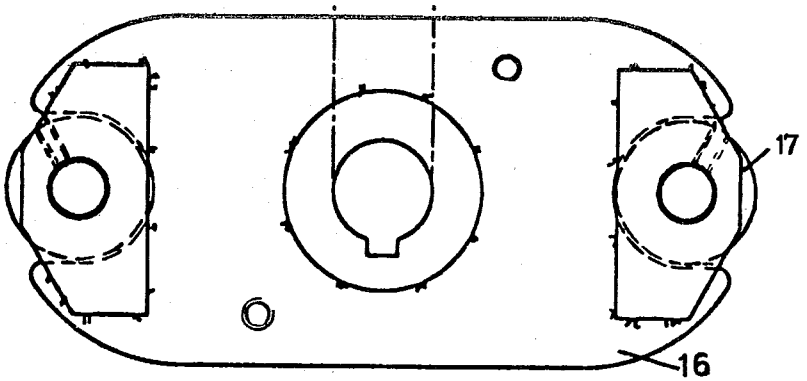
Figure 4A:
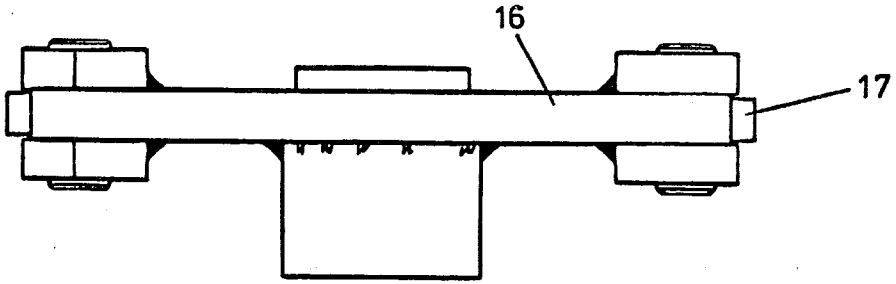

The more detailed development of the cam disc 16 is more clearly illustrated in FIG. 4A, 4B and 4C. It has the shape of a parallelogram, whereby the two short sides are rounded off in the shape of an arc. When turning the cam disc through an angle of about 40°, the disc 16 comes into contact with the base plates 4. In this area, the clamping disc has a radius increasing approximately sinusoidally which increases according to the example shown of a 40° rotation from a radius value of from about 55 mm to 75 mm. As a result the base plates 4 are forced by the plate spring 5 against the cam disc, whereby this movement takes place at first slowly and then quickly. The movement is transferred to the clamping arms 3 which force the brake shoes 8 against the rail 1. Above the adjusting path of the greatest effective pressure in the area of the above mentioned arc-shaped rounding off, grooved ball bearings 17 are provided which ensure a quick and unimpeded release of the cam disc from the brake pincers.

Figures 6, 7:
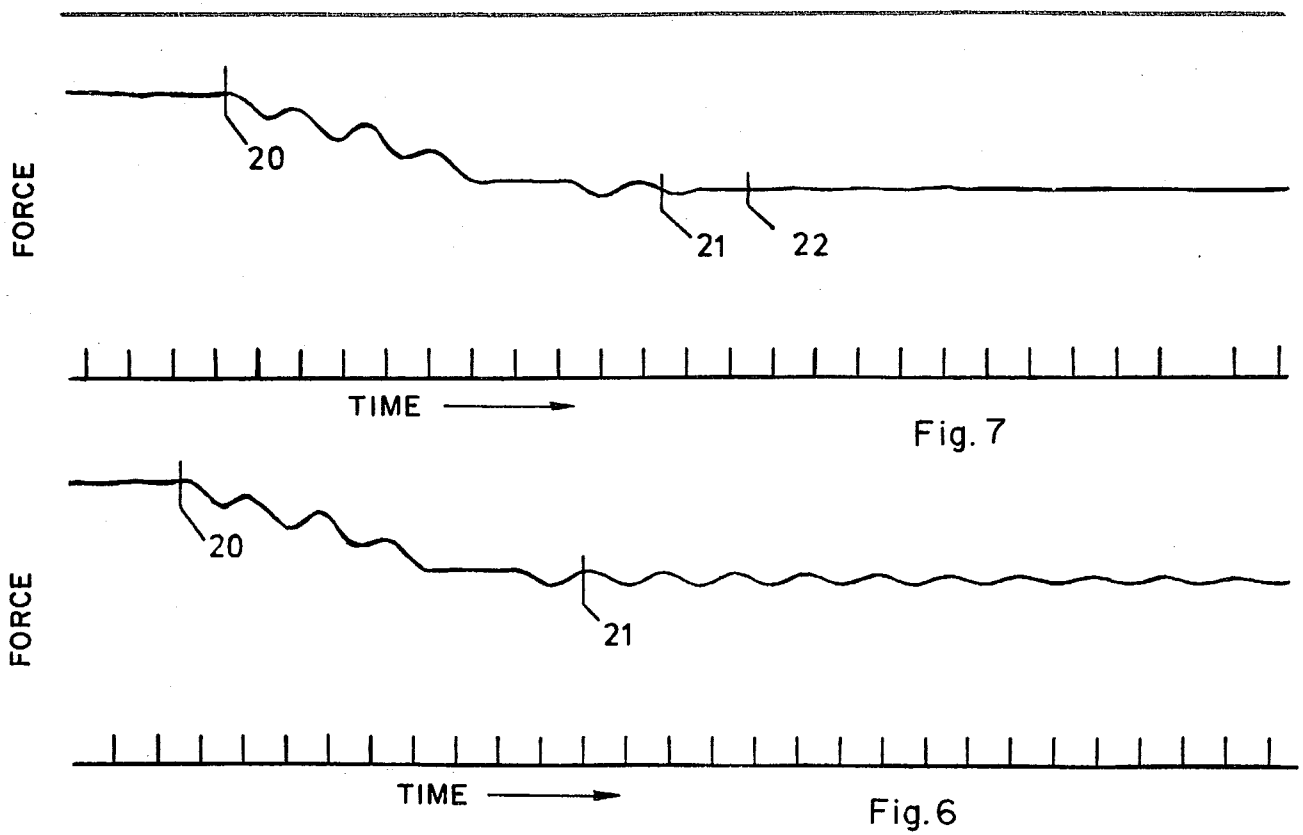

FIGS. 6 and 7 show two vibration oscillograms, whereby the test values shown occur between the mast head of a storage machine over 30 m high and the upper guide rail 1. The horizontal axes carry time markings, and the distance between two markings on the horizontal scale corresponds to 1 second.

One can clearly recognize from FIG. 6 that the mast has leading and lagging oscillations whenever the storage machine is slowed down beginning from position 20. The theoretical position is reached at point 21, whereby the final oscillations of the mast head may last as long as 16 seconds until they fade sufficiently.

The results are different in the case of use of the process proposed for the operation of the rail brake described. Upon reaching the theoretical position 21, the rail brake is activated for about 1 second, whereupon in the case of standstill of the storage machine, no more vibrations occur at the mast head. The storing in and removing may be started without loss of time.

In the case of standstill, standard movement and in the case of emergency switch off, the rail brake remains released. The braking time may be adjusted infinitely variably by way of the servo motor 18 over an area of 1-3 seconds. The braking force may be regulated by way of the set screw 15, so that the braking effect may be adapted advantageously to the pertinent constructional occurrences, whereby natural frequencies of a temporal distance are brought about between the frequencies of the vibrating forces and the machines. As a result of the progressive braking effect, the brake linings and the guide rail are protected.

The storage machine movable on the floor rail executes a preprogrammed movement. The same preprogramming also controls the servo motor 18 for the operation of the cam disc by triggering a braking delay in the manner described at predetermined positions of the path that is to be covered. This mechanically triggered braking delay rises unevenly, preferably sinusoidally from zero up to a maximum value. In this way, preprogrammed movements are carried out unimpeded and without loss of time since no vibrations can occur at the mast head.

I claim:

1. A braking system for a freight or crane module suspened for movement on an overhead guiding rail having the form of an I beam with upper and lower flanges and a vertical web comprising:

a pair of pivoted braking pincers for stopping the movement of said module along said rail, each of said pincers having a brake shoe and an upper arm portion for pushing said brake shoe against a side of the vertical web of the I beam and a lower arm portion which diverges outwardly and downwardly so as to be disposed with the lower arm portions of the pincers in pivotally joined relationship about a pivot pin located below the I beam;

said pivot pin pivotally mounting both upper arm portions about a horizontal axis parallel to the flanges of said I beam;

said brake shoes having a lining formed of plastic, one of said brake shoes being attached to each upper arm portion of said braking pincers, respectively, to press said brake lining of each shoe against opposite sides of the I beam and in the released state to have sliding characteristics therewith;

a tension spring connected to said pair of pincers;

said outwardly diverged lower arm portions of said braking pinsers having a first lower portion defining a first open area therebetween in the shape of a triangle and the tension spring engaging the pincers along the base of the triangle;

said outwardly diverged lower arm portions having a second lower portion defining a wider second open area therebetween generally rectangular in shape and lying below the base of the triangular open area;

a generally parallelogram shaped cam disc having contoured arcuate sides for spreading the lower arm portions outwardly by a rotation thereof and acting against the action of said tension spring, said cam disc thereby providing a non-locking braking action by progressively increasing the brake action and urging said brake shoes against the vertical web of said I beam so that the clamping pressure rises unevenly from zero to a maximum;

base plates, one on each second lower portion, engaging the arcuate ends of said cam disc;

adjustable base plate spring means on said base plates forcing plates against the cam disc to assure quick braking action in a period of about 1 to 3 seconds;

said cam disc overcoming the pressure of said base plate spring means so that its rotation to a maximum clamping force is dampened progressively;

a spacer sleeve means housing said base plate spring means on said second lower portions;

servo motor means including an output shaft for rotating said cam disc between said base plates; and support means on the freight module for said motor means, cam disc, and tension spring and said braking pincers.

2. A braking system as claimed in claim 1 wherein the output shaft of said servo motor means rotates said cam disc through an angle of up to 40° thereby causing a displacement of from about 55 to 75 millimeters at a rate of movement which starts slowly and ends quickly thereby preventing vibration of the freight module upon braking and wherein grooved ball bearings are provided on said cam disc thereby assuring quick release of the cam disc.

3. A braking system as claimed in claim 1 wherein said spring means for said plates is further provided with set screw means for adjusting the spring tension and reducing or increasing the time for applying the brakes.

* * * * *